United States Patent [19]

Sasaki et al.

[11] 4,262,346

[45] Apr. 14, 1981

[54] MULTI FUNCTION ELECTRONIC TIMEPIECE

[75] Inventors: Seiko Sasaki; Kazuhiro Asano, both of Tokyo, Japan

[73] Assignee: Kabushiki Kaisha Daini Seikosha, Tokyo, Japan

[21] Appl. No.: 49,476

[22] Filed: Jun. 18, 1979

[30] Foreign Application Priority Data

Jun. 20, 1978 [JP] Japan ..... 53-74644

[51] Int. Cl.[3] ..... G04B 3/12

[52] U.S. Cl. ..... 368/62; 368/21; 368/22; 368/251

[58] Field of Search ..... 58/23 R, 23 BA, 50 R, 58/152 R, 4 A, 57.5; 364/705; 368/10, 62, 69, 82, 83, 84, 87, 239, 241, 242, 21, 22, 251

[56] References Cited

U.S. PATENT DOCUMENTS

| | | | |
|---|---|---|---|
| 3,707,071 | 12/1972 | Walton | 58/50 R |
| 3,765,163 | 10/1973 | Levine et al. | 58/50 R |
| 3,921,384 | 11/1975 | Moyer | 58/50 R X |
| 3,955,355 | 5/1976 | Luce | 58/152 R X |
| 4,074,513 | 2/1978 | Donze et al. | 58/4 A |
| 4,093,992 | 6/1978 | Kawamura et al. | 58/23 BA X |

*Primary Examiner*—Ulysses Weldon

*Attorney, Agent, or Firm*—Robert E. Burns; Emmanuel J. Lobato; Bruce L. Adams

[57] ABSTRACT

Circuitry for reducing power consumption in a multi function electronic timepiece utilizes a low frequency signal from the timing pulse generating circuit and a halt signal from the time signal processing circuitry to inhibit the feeding of timing signals to the processing circuitry after the receipt of a halt signal signifying the end of a function routine and until the receipt of the next low frequency signal.

4 Claims, 4 Drawing Figures

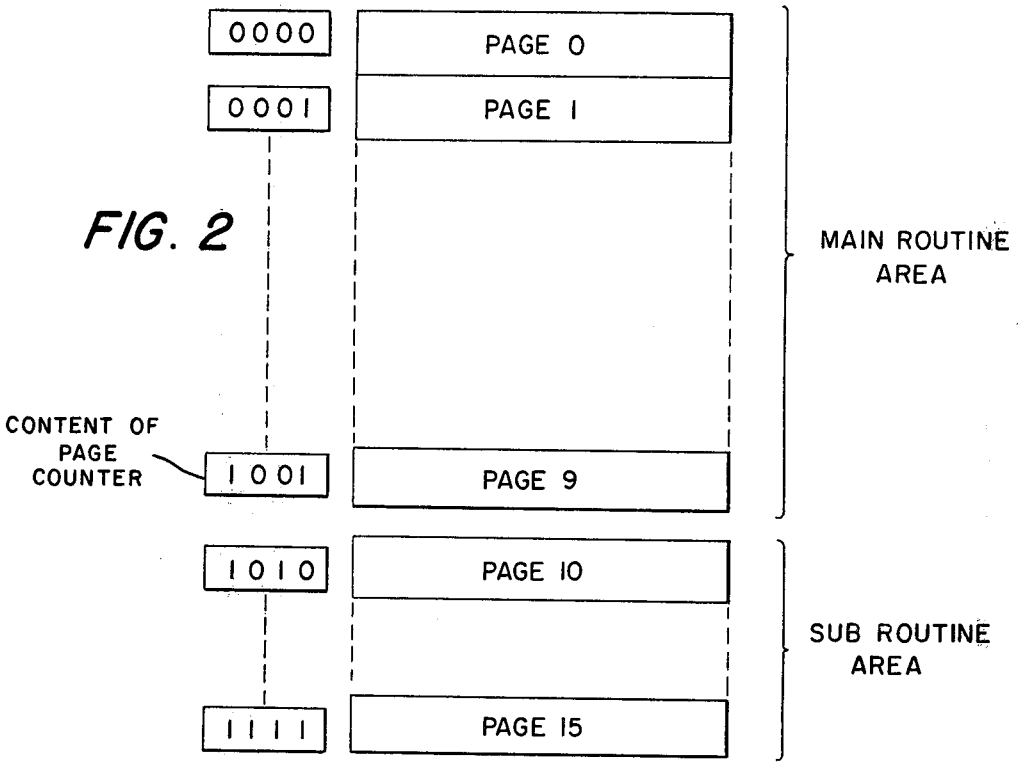
FIG. 2
FIG. 3(a)
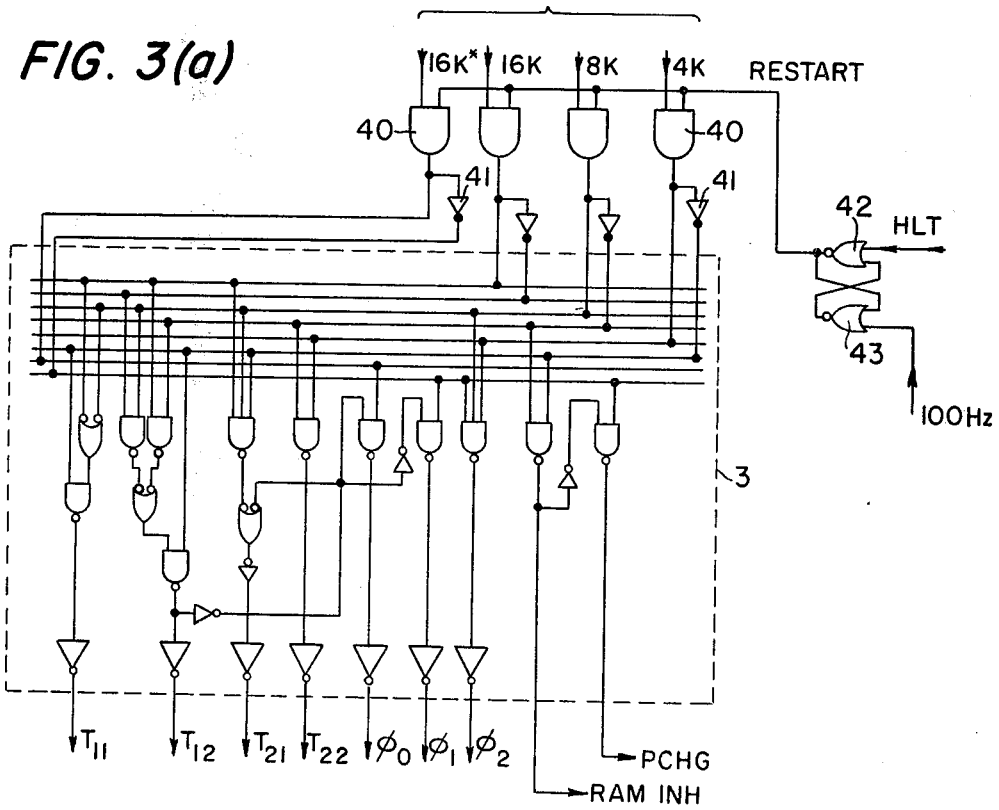

MULTI FUNCTION ELECTRONIC TIMEPIECE

BACKGROUND OF THE INVENTION

The present invention relates to a multi function electronic timepiece of the type which has functions such as timing, alarm, calculation, calendar, etc., more particularly, to an improved system for reducing current in a multi function electronic timepiece having a ROM-RAM (Read-Only Memory-Random Access Memory) system. Recently, multi functions in an electronic timepiece have been developed remarkably thanks to advancements in electronics, especially IC (Integrated Circuits) techniques. For example, an alarm watch, a watch with a timer or a calculator have appeared.

Thus, as the development in multi-function goes on, a problem of a limit of the number of functions comprised in the IC chip develops; especially since a rise in chip size of the IC using static C-MOS circuitry makes an increase in cost. Thus, a CPU (Central Processing Unit) system using a new circuit system including a ROM-RAM which replaces the IC using C-MOS has began to be studied and developed and is now on the market partially.

However, terminals of a ROM or RAM operate dynamically, so that a clock frequency which is sufficiently higher than that of a conventional static circuit is used. Therefore the energy consumption is great, and countermeasures have been required. Power consumption P is shown as follows: $P=C\cdot V^2\cdot f$.

As countermeasures, reduction of source voltage V, reduction of circuit driving frequency f, or reduction of stray capacitance C are considered. However, V has the limit of around 1.5 V in the case of an electronic timepiece. As for frequency f, it has also its limit because too big reduction makes the conductability drop. And stray capacity is much less hopeful because it has intimate relation with manufacturing process of the IC.

According to the present conditions mentioned above, in the case where carry is not output; a system by which a clock pulse is inhibited until a carry is output; and a system constituted so that a clock pulse is output when a switch input or base time input signal, for example, the 1/10 second signal comes and said clock pulse is stopped by an output from a program memory means; are proposed or put into practical use.

However, the countermeasurer described above are not sufficient because only an output of a timing pulse generating circuit is controlled in any case. Therefore a logic gate circuit in said timing pulse generating circuit repeats ON and OFF with a still high frequency, for example, 16KHz, 8 KHz, 4 KHz and the like.

SUMMARY OF THE INVENTION

The object of this invention is to improve such a disadvantage and it aims to reduce power consumption of a multi function electronic timepiece by stopping a timing pulse generating circuit which was operated with high speed, by inserting AND or OR logic circuit between the timing pulse generating circuit and a part of the output of the dividing circuit and controlling the AND or OR logic circuit.

BRIEF EXPLANATION OF THE DRAWINGS

FIG. 2 is an explanatory drawing which shows the composition of the ROM;

FIG. 3 (*b*) is a time chart of the pulse of the timing pulse generating circuit.

DETAILED DESCRIPTION OF THE INVENTION

Figure 1:
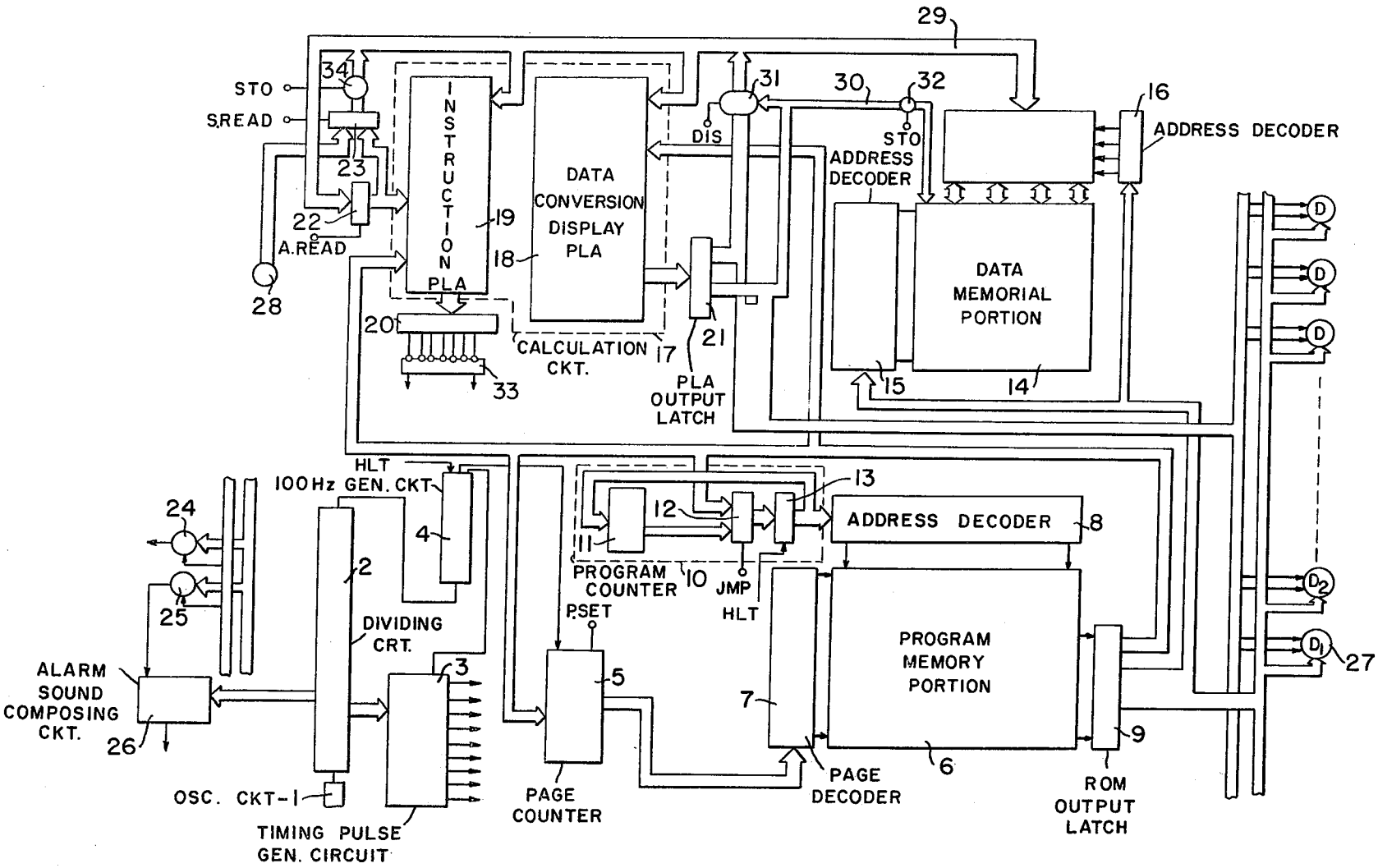
FIG. 1 is a block diagram of one embodiment of the invention.

FIG. 1 is a block scheme of this invention. The output of a quartz oscillation circuit 1 as a time base generating circuit is put in a dividing circuit 2, a part of the output of said dividing circuit is put in a timing pulse generating circuit 3, and another part is put in an alarm sound comprising circuit 26. And another part of the output is put in a 100 Hz generating circuit 4. The output of said timing pulse generating circuit 3 puts out a signal necessary for dynamic operating. The 100 Hz signal which is output from said 100 Hz generating circuit 4 is put in a page counter 5 and in the timing pulse generating circuit 3.

On the other hand, a jump page address signal which is a part of the output from ROM output latch circuit 9 which receives output from ROM 6 as a program memory is put in the page counter 5.

Page information which is output from the page counter 5 is put in a page decoder 7. Output of the page decoder 7 becomes a part of the address of a program memory portion 6, while the output of a program counter 10 is put in an address decoder 8, and the output thereof also becomes a part of the address of the program memory portion 6. The output of the program memory portion 6 is put in the ROM output latch circuit 9, and the output thereof is put in address decoders 15, 16 of a data-memorial portion 14, output latch circuits 24, 25, 27, a calculation circuit 17, the program counter 10, and the page counter 5. The program counter 10 is constituted by a half adder circuit 11, switching circuit 12, and a ROM address latch circuit 13 which is capable of set-reset. As the input of the half adder circuit 11, the output of said ROM address latch circuit 13 is applied, and the output thereof is put in one of input terminals of said switching circuit 12 and a part of the output from said ROM output latch circuit 9 is put in the other input terminal thereof. The output of the ROM address latch circuit 13 is, as described above, put in the half-adder circuit 11, and in said address decoder 8 at the same time.

In the data memorial portion 14, 4 bits-data bus 29, data memory bit conduct signal bus 30 are input, in addition to the output signal of the address decoders 15, 16. The data bus of 4 bits is bi-directional bus and the content in said data memory 14 is put in a calculation circuit 17 and the accumulator 22.

The calculation circuit 17 is constituted by a data conversion-display PLA (Programmable Logic Atray) 18 and instruction PLA 19. The data bus 29 and the part of the output from the ROM output latch 9 are put in PLA 18, and output of the PLA 18 is put in PLA output latch 21. And, in the instruction PLA 19, the data bus 29, a part of output from the ROM output latch 9 and the output of the accumulator 22 are input, and output of the PLA 19 is put in PLA output latch 20. The output of said PLA output latch 21 is put in gate circuits 31, 32, and output latch circuits 24, 25, 27 and the output of said PLA output latch circuit 20 is put in a gate circuit 33. The switching circuit 23 puts an exterior switch 28 and the output of the accumulator 22 in, and the output thereof is put in the data bus 29 via a gate circuit 34. Block 26 is an alarm sound composing circuit and puts an output latch 25 and a part of output of the dividing circuit 2 in, and the output thereof is put in an alarm driving circuit (not shown in the drawing.)

Referring now to the total operation of the present embodiment constituted as stated above.

The dividing circuit 2 in which a signal of 32,768 Hz is introduced from the quartz oscillating circuit 1 as the oscillating frequency applies dividing signals of 16,384 Hz, 8,192 Hz and 4,096 Hz in the timing pulse generating circuit 3 for generating timing signals necessary to operate said ROM 6, RAM 14, and PLA 18, 19 of the calculating circuit 17. The timing pulse generating circuit 3 generates timing pulses of RAM-INHIBIT, RAM-PCHG, $T_{11}$, $T_{12}$, $T_{22}$, $\phi_0$, $\phi_1$, $\phi_2$, each of which has a frequency of 4,096 Hz, where the RAM-INHIBIT signal is for inhibitting during certain term, address-appointment, RAMPCHG is a signal to pre-charge the data bus 29 in the term of inhibition of said RAM address-appointment, $T_{11}$ is a signal which pre-charges or evaluates a page decoder 7 and address decoder 8, $T_{12}$ is a signal which precharges or evaluates ROM 6, $T_{21}$ is a signal which pre-charges or evaluates the AND array portion (not shown) of PLA 18, 19, and $T_{22}$ is a signal which precharges or evaluates the OR array portion (not shown) of said PLA 18 and 19. And $\phi_0$ is a timing signal which memorizes in the ROM output latch 9, program data put out from said ROM 6, $\phi_1$ is a timing signal which memorizes in PLA output latch 20 and 21, data put from said PLA 18, 19, $\phi_2$ is a readin timing signal of ROM address latch 13 which memorizes the NEXT address of the ROM 6.

Different pulse signals generated from said timing pulse generating circuit 3 are introduced respectively in ROM 6, the page decoder 7, the address decoder 8, the address decoders 15, 16 of RAM 14, PLA 18, 19, ROM output latch 9, ROM address latch 13 and PLA output latch 20 and 21.

The 4,096 Hz signal divided by the dividing circuit 2 is put in the 100 Hz-generating circuit 4, the output thereof is put in the page counter 5 and becomes a clock signal. At the same time, it is put in the timing pulse generating circuit 3. Said page counter 5 is a 4 bit hexadecimal counter capable of being pre-set and which operates as decimal counter synchronizing with said clock signal normally. Therefore, the output thereof counts from page No. 0 to No. 9 at the interval of 0.1 second. However, when an order of page jump is put out, as an information from said ROM 6, data introduced from ROM output latch 9, is preset in the page counter 5. In this case, arbitrary information from Page No. 0 to No. 15 can be pre-set. In the embodiment of the present invention, Pages of No. 0 to No. 9 are used at ordinary times for main routine-use and No. 10–No. 15 are used for sub routine-use. FIG. 2 shows the structure of the ROM.

Referring next to the operation of a program counter 10, supposing that a job of ⌜A⌟ address is done now, jump address ⌜B⌟ of 6 bits encoded into ⌜A⌟ addressis put in a switching circuit 12. At this moment, if the output from the instruction PLA 19 orders "jump", said switching circuit 12 does not select the output of 6 bits put out from the half adder circuit 11 but selects jump address ⌜B⌟ and memorizes in ROM address latch 13, the jump address and practices the job of jump address ⌜B⌟. If the jump order is not put out from said instruction PLA 19, 1 is added to address ⌜A⌟ which is now in practice, by the half adder circuit 11 and becomes the NEXT address. The content: ⌜A+1⌟ is memorized in ROM address latch 13 via said switching circuit 12 and at the next moment, it practices the job of ROM address ⌜A+1⌟. Renewal of each address is done every 1/4096 second, i.e., every 250 μs. As described above, as the page counter 5 does a decimal countoperation making the 100 Hz signal a clock input, the time necessary for changing content in the counter is 10 ms. Therefore, 40 instructions are possible to be practiced in 1 page. As is understood by above description, ROM 6 receives as address information, informations made by the page decoder 7 and the address decoder 8 by decoding outputs from the page counter 5 and the program counter 10 as 4→16, 6→64, and calls each memorized information and practices a predetermined operation.

The information of the 19 bits put out from ROM 6 is put in ROM output latch 9, and this information is memorized in ROM output latch 9 at the timing of $\phi_0$. The datum put out from ROM output latch 9 is maintained until the next pulse $\phi_0$ comes. Data of 19 bits which are put out is constituted by main 3 parts; the first part thereof is constituted by 7 bits wherein order-code is memorized and in the second part, wherein a jump address or a code of the output port is memorized. And in the third portion, an address of RAM 14 is memorized. These data of 19 bits are put in program counter 10, address decoders 15 and 16 of RAM 14 and the calculation portion 17 or the page counter 5. They are also put in output 24,25 and 27.

A RAM cell of 1 word (4 bits) in RAM 14, which is appointed by address information put in address decoders 15, 16 at the timing of $\phi_0$, is put in the data conversion-display PLA 18 of the calculation circuit 17, the instruction PLA 19 or in the accumulator 22. Another part of information of 7 bits (order code) is put in said calculation circuit 17, too. PLA 18 and 19 which constitute the calculation circuit 17 execute +1, −1, converison into display segment data, decoding or conduct at every bit of other RAM data which is put in, according to order codes. Further, it compares accumulator 22 with RAM data, or executes condition-decisions with RAM data obeying merely said order code and generates a concrete order signal. The operations as described above are all executed by the timing of $\phi_0$.

Various generated data of PLA 18, 19 are put in PLA output latches 20, 21. The latches 20, 21 memorize each data at the timing of $\phi_1$. Information of PLA output latch 20, 21 is maintained until arrival of a timing pulse of $\phi_1$. Informations memorized in PLA output latch 20 are various concrete order the signals, content of which is shown in Table-1.

TABLE-1

| Names of output signal of PLA 20 | Operations |
|---|---|
| S. READ | read-in signal of exterior switches |
| A. READ | signal which reads data from RAM into accumulator |
| STO | signal which writes in RAM, exterior switches, accumulator or calculation result. |
| DIS | signal which makes display data decode into display signal. |
| P. SET | signal which sets page jump address in page counter |
| JMP | signal which selects jump address |
| HLT | signal which stops a part of operation of system |

The content memorized in PLA output latch 21 is a result of a time calculation and the like (+1, −1 or conduct of a bit) or content decoded into data for display.

Output data of PLA output latch 20 or 21 is put out via each gate, for example, gates 31, 32, and 33, at the timing. For example, output data of PLA output latch 20, i.e., various instruction signals (STO, DIS, JMP and the like) are introduced into switching circuit 12, 23 or gates 31, 32, and 34 and the like at the timing of $\phi_2$, or introduced into each counter, latchs 5, 13, 22 or 100 Hz generating circuit 4 and execute predetermined circuit operations systematically.

Therefore, at the timing of $\phi_2$, concrete operations as follows are executed.

(1) rewriting of RAM data.
(2) display.
(3) reading in of data into accumulator.
(4) reading in of exterior switch information.
(5) +1/switching of jump address
(6) reading in of page jump address
(7) execution of HLT order (stopping of a part of the system operated dynamically)

Here, executing of job of (5) and (6) means preparation for executing of next order.

Thus, 1 instruction is executed in 250 μs and desired various time calculations are able to be practiced by repeating these operations.

Figure 3B:
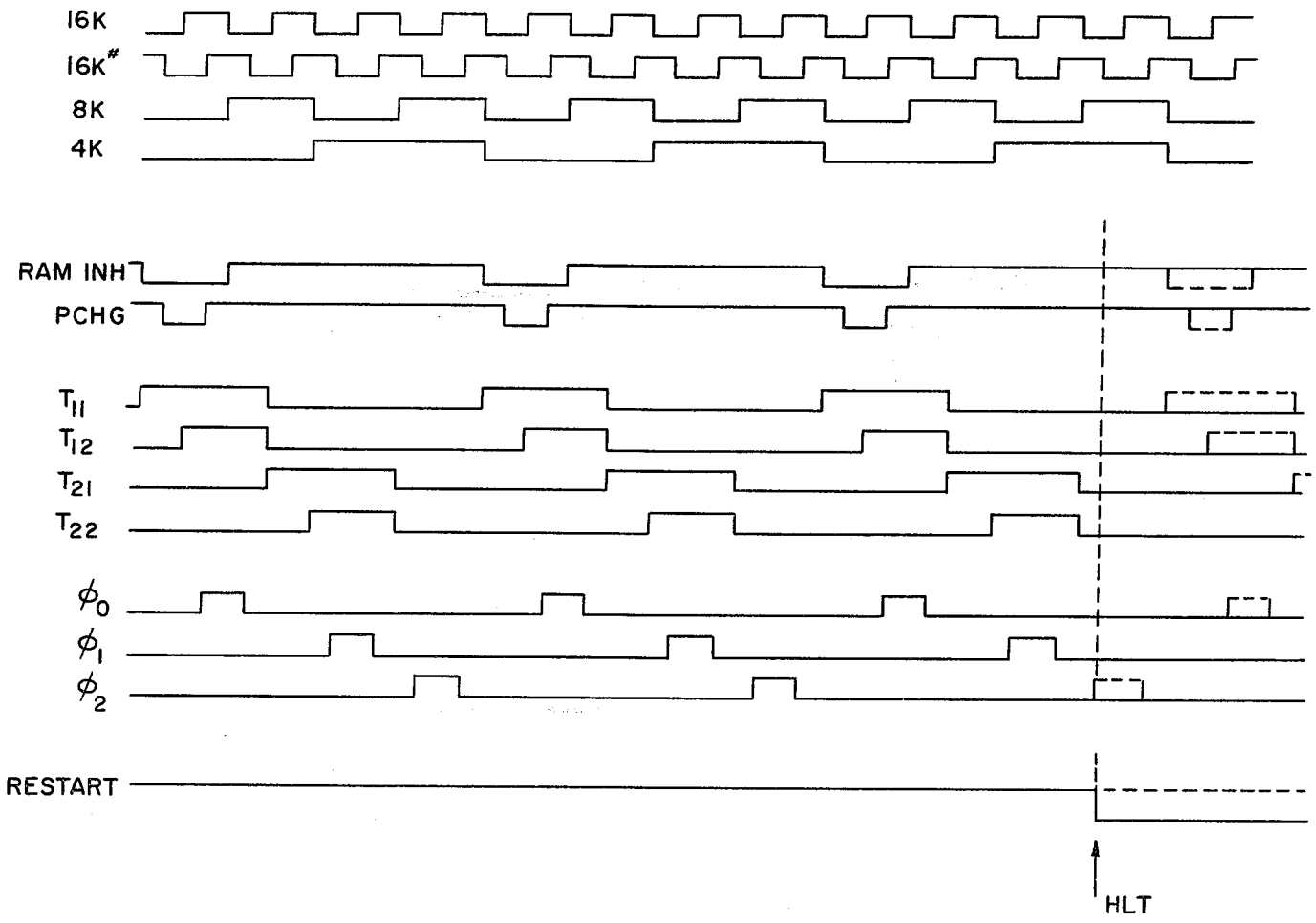
FIG. 3(*a*) is a detailed drawing of the timing pulse generating circuit.

FIG. 3 (*a*) is a more detailed circuit scheme of the timing pulse generating circuit 3.

Outputs from the dividing circuit 2, 16 kHz, 16* kHz (a signal phase of which is different from 16 kHz signal by 180°), 8 kHz, and 4kHz are put in AND gate 40. The output of each AND gate 40 takes a complemental signal by inverter 41, and signals: $T_{11}$, $T_{12}$, $T_{21}$, $T_{22}$, $\phi_0$, $\phi_1$, $\phi_2$, and RAM INH and PCHG are put out as output signals. In the other input terminal of said AND gate, the RESTART signal is connected as one output of SET RESET FF constituted of NOR gates 42, 43. And in one of the input terminals of NOR gate 42, the HLT signal which is decoded into the desirable signal in the PLA 19 receiving output of ROM 6 is put, and in one of input terminals of NOR gate 43, the output of the 100 Hz signal generating circuit 4 is put. When the 100 Hz signal is put in the SET·RESET·F·F, the RESTART signal becomes a ⌜1⌟ level, and the AND gate 40 opens and 16* kHz, 16 kHz, 8 kHz and 4 kHz pass and predetermined timing pulse is generated. As the order of ⌜HLT⌟ is executed when the job in the page is concluded, the code of ⌜HLT⌟ memorized in ROM 6 is decoded in PLA 19 and is output at the timing of $\phi_2$ from the gate circuit 33 and is put in one terminals of NOR gate 42, and the SET·RESET F·F constituted of NOR gates 42, 43 becomes under the reset condition, and the RESTART terminal is changed from ⌜1⌟ to ⌜0⌟. As AND gate 40 closes, pulses from the dividing circuit do not pass each AND gate 40, therefore a timing pulse is not generated. This state is maintained until a 100 Hz signal is generated again and the SET·RESET·F·F is reset. The state of things described above will be understood by referring to the time chart 3 (*b*).

As stated above, by constituting as the present invention, i.e., by controlling one part of output of the dividing circuit 2 which is put in the timing pulse generating circuit 3 or the alarm sound composing circuit 26 equivalently by AND or OR logic circuit, suspension of high-speed operation as occasion demands and lowering of power consumption is realized. Therefore, the effect of this invention is great by the contribution in the lowering of electric power consumption in a dynamic-operation system, especially a ROM-RAM system.

What we claim is:

1. A multi function electronic timepiece comprising: a crystal oscillator as a time base generating circuit; a dividing circuit which divides the output of said crystal quartz oscillator; a timing pulse generating circuit whose input is an output of said dividing circuit and which generates a timing pulse signal for operating various circuit blocks; a ROM as a program memory portion wherein a program for executing the timepiece operation and other multi function operations are memorized; a RAM as a data memory portion for control; a program and page counter for renewing the address of said ROM; a calculation circuit portion; a latch circuit as an output data memory circuit which temporarily memorizes display data or other necessary output data; a driver circuit to display all or part of the data of said latch circuit; an alarm sound circuit whose input is one part of the output of said dividing circuit; and means responsive to the output of said calculation circuit for controlling the part of the output of said dividing circuit input to said timing pulse generating circuit.

2. A multi function electronic timepiece according to claim 1 wherein the means for controlling comprises a logic circuit having one input receptive of an output of the dividing circuit and another input connected to one part of the output of said calculation circuit and to an output of a memory circuit whose input is a signal of 100 Hz, and means for applying the output of the logic circuit to said timing pulse generating circuit.

3. In a multi function electronic timepiece of the type having a time base oscillator for producing a high frequency signal suitable for use as a time base, a dividing circuit for dividing the oscillator high frequency signal to lower frequency signals including a given lowest frequency signal, a timing pulse generating circuit receptive of the divided lower frequency signals for developing timing pulse signals, and time signal processing circuitry receptive of the timing pulse signals for effecting the timpeiece functions including dynamic ROM and RAM elements for control; the improvement comprising means for reducing overall power consumption wherein the processing circuitry includes means for generating a halt signal when the processing circuitry has completed a desired function routine; and wherein the timing pulse generating circuit includes means receptive of the given lowest frequency signal and the halt signal for inhibiting the generating of the timing pulse signals for the processing circuitry after generation of the halt signal and until the presence of the next given lowest frequency signal.

4. The electronic timepiece according to claim 3; wherein the means for inhibiting comprises a set-reset flip-flop having the set input receptive of the halt signal and the reset input receptive of said given lowest frequency signal, and means for gating said divided lower frequency signals with the output of the flip-flop upstream of the generating of the timing pulse signals.

* * * * *